US007429833B2

(12) United States Patent
Peng

(10) Patent No.: US 7,429,833 B2
(45) Date of Patent: Sep. 30, 2008

(54) POWER-SAVING AND STABILIZING BALLAST

(76) Inventor: Junzhong Peng, Kanghua Mechanical & Electrical Co., Ltd., Baihuapu, Yangwu, Dalingshan Town, Dongguan (CN) 523800

( * ) Notice: Subject to any disclaimer, the term of this patent is extended or adjusted under 35 U.S.C. 154(b) by 0 days.

(21) Appl. No.: 11/622,102

(22) Filed: Jan. 11, 2007

(65) Prior Publication Data

US 2007/0267981 A1 Nov. 22, 2007

(30) Foreign Application Priority Data

May 16, 2006 (CN) ..... 2006 2 0058980

(51) Int. Cl.
*H05B 37/02* (2006.01)

(52) U.S. Cl. ..... 315/307; 315/224; 315/247

(58) Field of Classification Search ..... 315/209 R, 315/224–226, 246–247, 276, 291, 307–309, 315/312

See application file for complete search history.

(56) References Cited

U.S. PATENT DOCUMENTS 5,604,411 A * 2/1997 Venkitasubrahmanian et al. ..... 315/307
6,181,079 B1 * 1/2001 Chang et al. ..... 315/247
6,515,437 B1 * 2/2003 Zinkler et al. ..... 315/312
6,548,985 B1 * 4/2003 Hayes et al. ..... 320/108
6,784,624 B2 * 8/2004 Buonocunto ..... 315/247
6,956,336 B2 * 10/2005 Ribarich ..... 315/247
6,963,178 B1 * 11/2005 Lev et al. ..... 315/307
7,061,188 B1 * 6/2006 Katyl et al. ..... 315/291
2006/0038503 A1 * 2/2006 Hung ..... 315/224
2006/0049777 A1 * 3/2006 Kumagai et al. ..... 315/224
2007/0052373 A1 * 3/2007 Hui et al. ..... 315/291

* cited by examiner

*Primary Examiner*—Thuy Vinh Tran
*Assistant Examiner*—Tung X Le
(74) *Attorney, Agent, or Firm*—Global IP Services; Tianhua Gu

(57) ABSTRACT

A power-saving and stabilizing ballast includes a bridge rectifier circuit, an electrolytic capacitive filter circuit, a half bridge inverter circuit, and an LC output circuit, all of which are sequentially and electrically connected. An EMC filter circuit is electrically connected between a voltage input port and the bridge rectifier circuit for restraining high frequency currents from damaging electric power. A power factor correction circuit is electrically connected between the bridge rectifier circuit and the electrolytic capacitive filter circuit for enhancing power factor, reducing harmonic and achieving a constant power output. An abnormal state protection circuit is electrically connected to the half bridge inverter circuit for protecting the ballast against damage from abnormal states. The ballast is also capable of resisting transient spikes or strong thunder and lighting interferences from electric power, and suppressing surge currents effectively. The ballast has multi-loads output and start delay for prolong the lives of lamps or lanterns with such ballast.

9 Claims, 7 Drawing Sheets

POWER-SAVING AND STABILIZING BALLAST

CROSS REFERENCE TO THE RELATED PATENT APPLICATION

This application claims the priority of the Chinese patent application No. 200620058980.1, filed on May 16, 2006.

FIELD OF THE INVENTION

The present invention relates to a power-saving and stabilizing ballast, and more particularly to a power-saving and stabilizing ballast for fluorescent lamps.

BACKGROUND OF THE INVENTION

In the lamps and lanterns industry today, a conventional ballast comprises a power capacitor, a normally closed thermosentive switch, and a resistance thermometer sensor loop, etc. The ballast has strong shock noises and high temperature. Lamps or lanterns with such ballast usually have flickers. When the lamps or the lanterns are powered, the lamps or the lanterns cannot quickly light. Meanwhile, due to the voltage of the market power is instability, the ballast and the lamps or lanterns with such ballast are easy to burn out. This causes users much losing.

A new type ballast has good improvements in some parts. The circuit of the improved ballast includes a bridge rectifier circuit 21, an electrolytic capacitive filter circuit 22, a half bridge inverter circuit 23, and an LC output circuit 24. The circuit has good improvements in reducing shock noises, controlling temperature and quickly starting lighting etc. However, there are still many problems, such as lack of abnormal states protection. The common abnormal states are for example: one of the lamps is not connected; a fluorescent lamp can not start because of its cathode damaged; the cathode is normal, but the lamp can not be activated; during the fluorescent lamp working, a cathode cannot be activated or happens rectifier function; a short circuit is caused in the starter switch, etc. The electronic ballast and the fluorescent lamp (such as T5, T8 straight pipe or the other shape of the fluorescent lamps) generally cooperate with each other to work. Once an abnormal state happens during work, the ballast will be caused damage. Severing as an independently installed electronic ballast with the lamp tube being changeable, the ballast must have the abnormal states protection function. Even if abnormal states happen, the ballast does not damage. After a new lamp tube is changed, or after the abnormal state is eliminated, the ballast can still continue working.

In other aspects, for example, abilities to resist over-voltages, suppress surge currents, prolong the lives of the lamps or lanterns, multi-loads output, enhance power factor, reduce harmonic and achieve a constant power output, etc., the existing ballast for the lamps and lanterns has many shortages.

Therefore, there is a need for an improved power-saving and stabilizing ballast to overcome these above-mentioned disadvantages.

SUMMARY OF THE INVENTION

Accordingly, an object of the present invention is to provide a power-saving and stabilizing ballast capable of restraining high frequency currents from damaging electric power, suppressing surge currents effectively, enhancing coil power factor, reducing harmonic, achieving a constant power output, and having abnormal states protection function.

To achieve the above object, the present invention provides a power-saving and stabilizing ballast which includes a bridge rectifier circuit, an electrolytic capacitive filter circuit, a half bridge inverter circuit, and an LC output circuit, all of which are sequentially and electrically connected. The power-saving and stabilizing ballast further has an electromagnetic compatibility filter circuit electrically connected between a voltage input port and the bridge rectifier circuit for restraining high frequency currents from damaging electric power, a power factor correction circuit electrically connected between the bridge rectifier circuit and the electrolytic capacitive filter circuit for enhancing power factor, reducing harmonic and achieving a constant power output, and an abnormal state protection circuit electrically connected to the half bridge inverter circuit for protecting the ballast against damage from abnormal states.

Preferably, the electromagnetic compatibility filter circuit further comprises an over-voltage protection circuit for preventing transient spikes or over voltages from damaging the ballast. The over-voltage protection circuit includes a zinc oxide voltage dependent element.

Preferably, the abnormal state protection circuit further includes an over-current protection circuit for suppressing surge currents, and the over-current protection circuit has a current limiting resistor connected therein in series.

Preferably, the abnormal state protection circuit further includes an over-current protection circuit for suppressing surge currents, and the over-current protection circuit has a negative temperature coefficient resistor connected therein in series.

Preferably, The LC output circuit further comprises a pre-heating start-up circuit for providing a pre-heating current and a pre-heating time to a cathode of a fluorescent lamp before a system voltage thereof reaching a predetermined value, thereby avoiding glow discharge to cause the cathode damaged. The pre-heating start-up circuit has a thermosensitive element to heat glowers of the fluorescent lamp to a lighting temperature.

Preferably, the LC output circuit further includes a multi-loads working circuit for making at least two fluorescent lamps work simultaneity.

Preferably, the power factor correction circuit is an active power factor correction circuit.

The abnormal state protection circuit has transistors to detect the magnitude of the current, thus to control the half bridge inverter circuit.

Alternatively, the multi-loads working circuit is an LC lamps series resonance circuit.

Alternatively, the multi-loads working circuit is a current push-pull lamps output circuit.

By providing the electromagnetic compatibility (EMC) circuit, the ballast can suppress the high-frequency current to pollute the electric power; and by providing the power factor circuit, the ballast is able to enhance power factor and reduce harmonic and achieve a constant power output; and by providing the abnormal state protection circuit, the ballast is able to prevent the ballast from being damaged by abnormal states; and by providing the over-current protection circuit, the ballast suppresses surge currents effectively; and by providing the pre-heating start-up circuit, the ballast avoids glow discharge to cause the cathode damaged, thus to prolong the lives of the lamps and the lanterns.

Other aspects, features, and advantages of this invention will become apparent from the following detailed description when taken in conjunction with the accompanying drawings, which are a part of this disclosure and which illustrate, by way of example, principles of this invention.

BRIEF DESCRIPTION OF THE DRAWINGS

The accompanying drawings facilitate understanding of the various embodiments of this invention. In such drawings.

DETAILED DESCRIPTION OF ILLUSTRATED EMBODIMENTS

Figure 1:
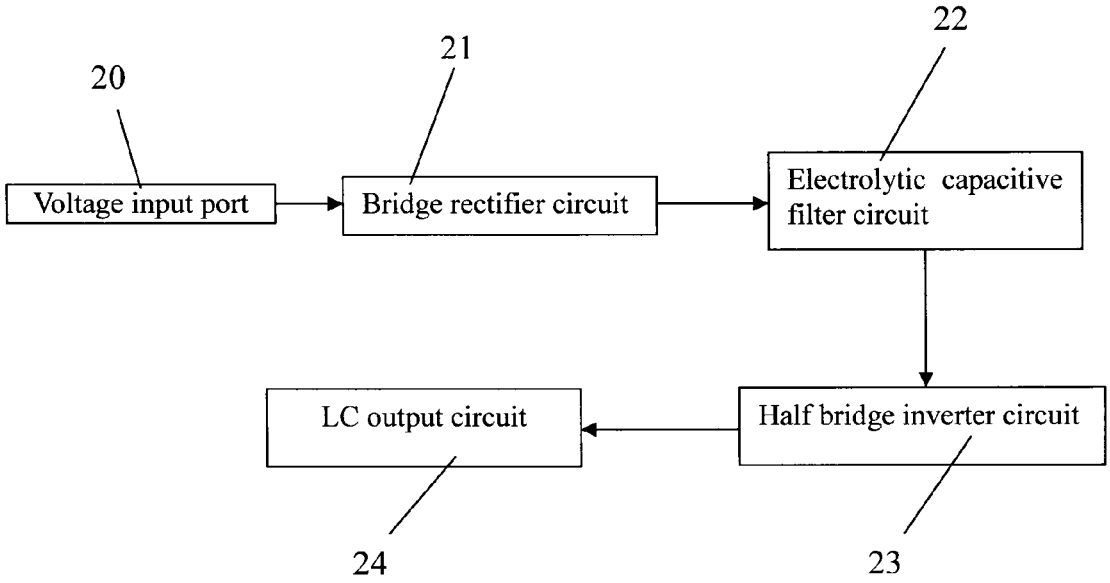
FIG. 1 (Prior Art)
FIG. 1 is a block diagram of a conventional ballast according to the prior art.

Various preferred embodiments of the instant invention will now be described with reference to the figures, wherein like reference numerals designate similar parts throughout the various views.

Figure 2:
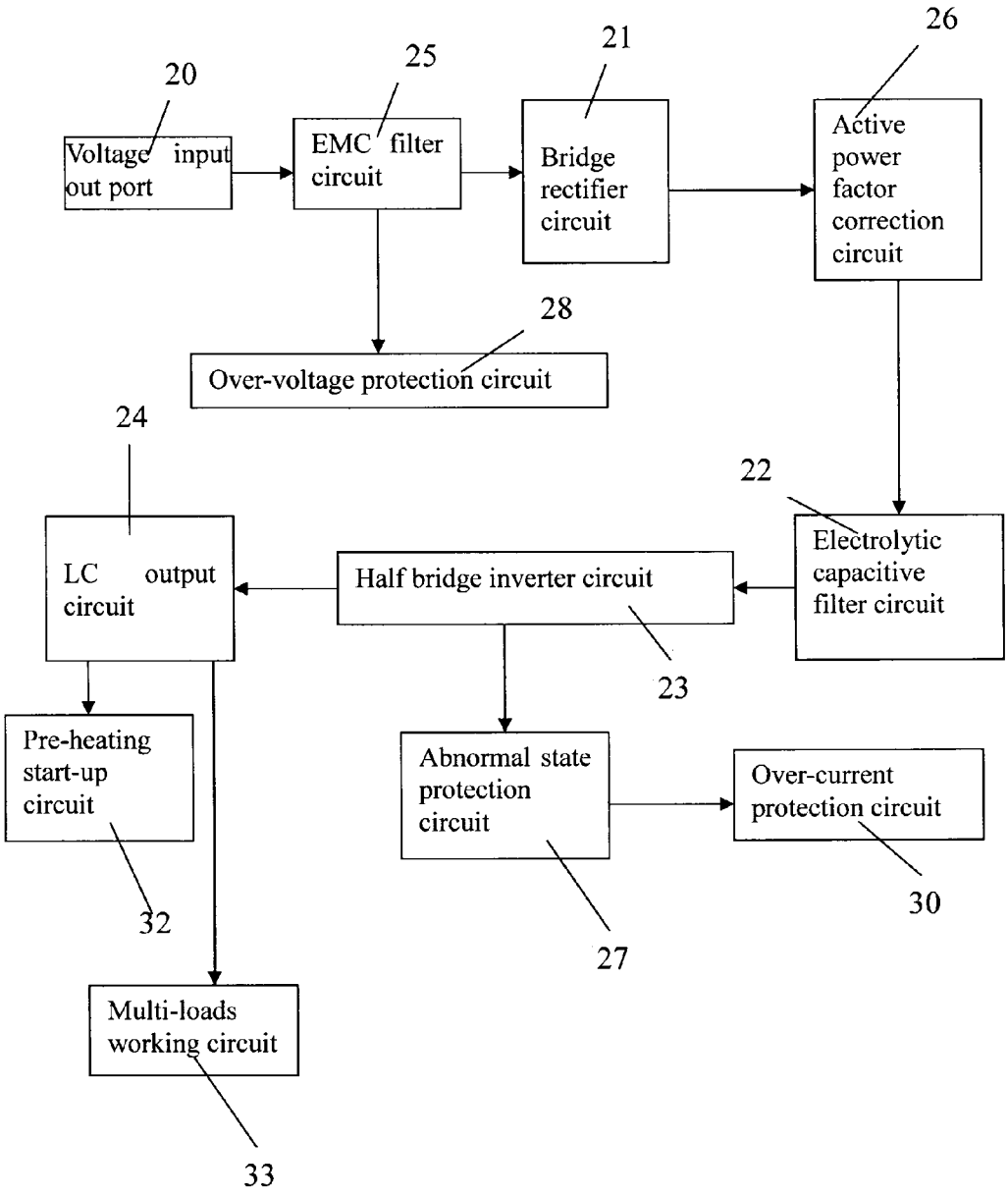
FIG. 2 is a block diagram of a power-saving and stabilizing ballast according to the present invention.

Referring to FIG. 2, a power-saving and stabilizing ballast of the present invention includes a bridge rectifier circuit 21, an electrolytic capacitive filter circuit 22, a half bridge inverter circuit 23, an LC output circuit 24, all of which are sequentially and electrically connected. The power-saving and stabilizing ballast further includes an electromagnetic compatibility (EMC) filter circuit 25 electrically connected between a voltage input port 20 and the bridge rectifier circuit 21 for restraining high frequency currents from damaging electric power; a power factor correction circuit 26 electrically connected between the bridge rectifier circuit 21 and the electrolytic capacitive filter circuit 22 for enhancing power factor, reducing harmonic and achieving a constant power output; and an abnormal state protection circuit 27 electrically connected to the half bridge inverter circuit 23 for protecting the ballast against damage from abnormal states.

Figure 3:
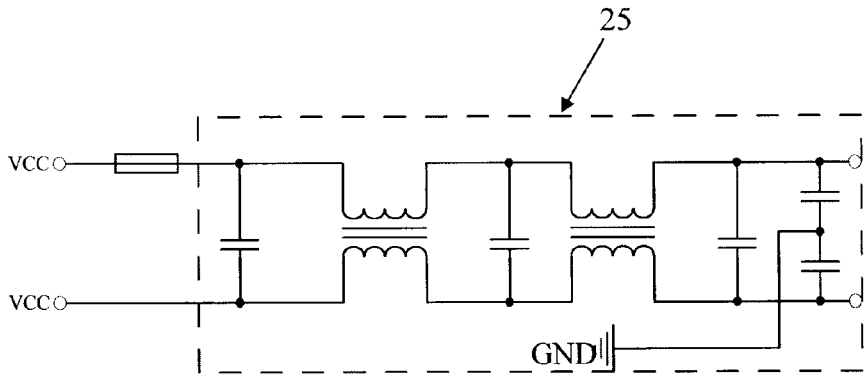
FIG. 3 is a circuit diagram of an electromagnetic compatibility (EMC) filter circuit of the present invention.

Referring to FIG. 3, a circuit diagram of the EMC filter circuit 25 is shown. The EMC filter circuit 25 consists of resistors and capacitors.

Figure 4:
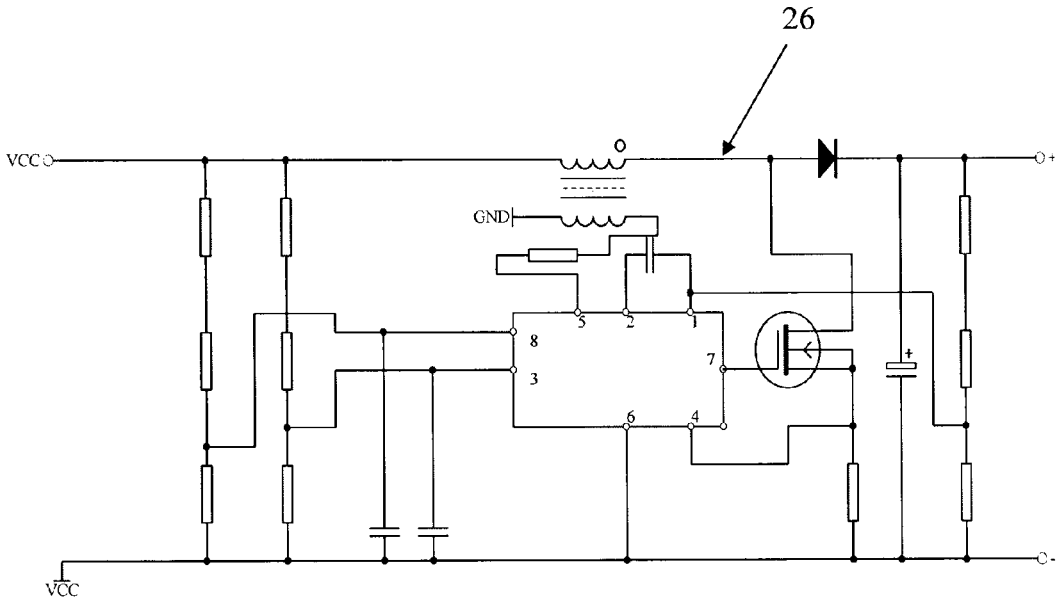
FIG. 4 is a circuit diagram of an active power factor correction (APFC) circuit of the present invention.

Referring to FIG. 4, the power factor correction circuit 26 in the present embodiment is preferably an active power factor correction (APFC) circuit composed of a special integrated circuit, a transistor and some peripheral electronic components. Relating to active components, so the power factor correction circuit 26 is named APFC circuit.

Figure 5:
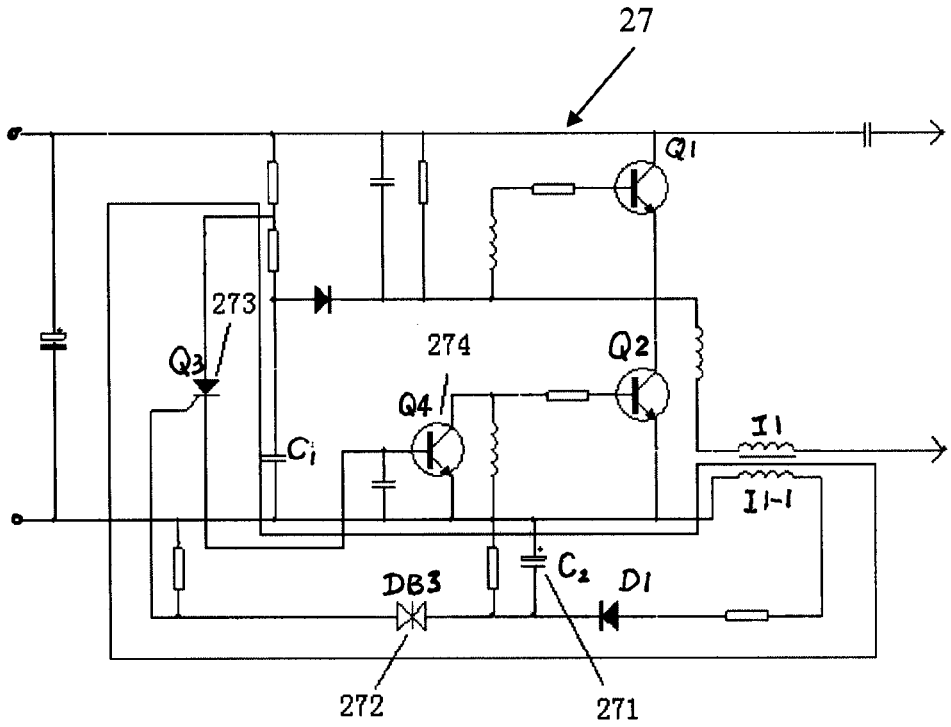
FIG. 5 is a circuit diagram of an abnormal state protection circuit of the present invention.

Referring to FIG. 5, a circuit diagram of the abnormal state protection circuit 27 is shown. As is shown, the capacitor 271 is arranged a secondary winding. Thus, in the normal work state, the voltage induced on the capacitor 271 is only 20-25V (or lower). Such low voltage cannot turn on the bidirectional diode 272, so the diode 273 and the dynatron 274 cannot get enough base currents and trigger currents, and therefore the diode 273 and the dynatron 274 are in cut-off and short state. In such condition, the abnormal state protection circuit 27 does not work. Once an abnormal state happens, the voltage induced on the capacitance 271 immediately exceeds to the trigger voltage needed to trigger the bidirectional diode 272. This voltage makes the bidirectional diode 272 turn on and, in turn, turns on the diode 273 and the dynatron 274 with the result that the half bridge inverter circuit 23 stops working and does not turn on again until the abnormal state is eliminated.

Figure 6:
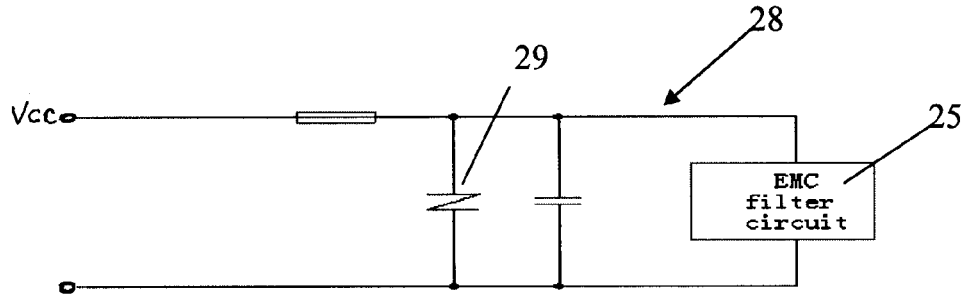
FIG. 6 is a circuit diagram of an over-voltage protection circuit of the present invention.

Referring to FIG. 6, the present invention provides an over-voltage protection circuit 28. The over-voltage protection circuit 28 has a zinc oxide voltage dependent element or resistor 29 connected in Parallel to the EMC filter circuit 25, which clips transient spikes or limits amplitude of over-voltages, thereby reduces the voltage of the ballast to prevent transient spikes or over voltages from damaging the ballast.

Figure 7:
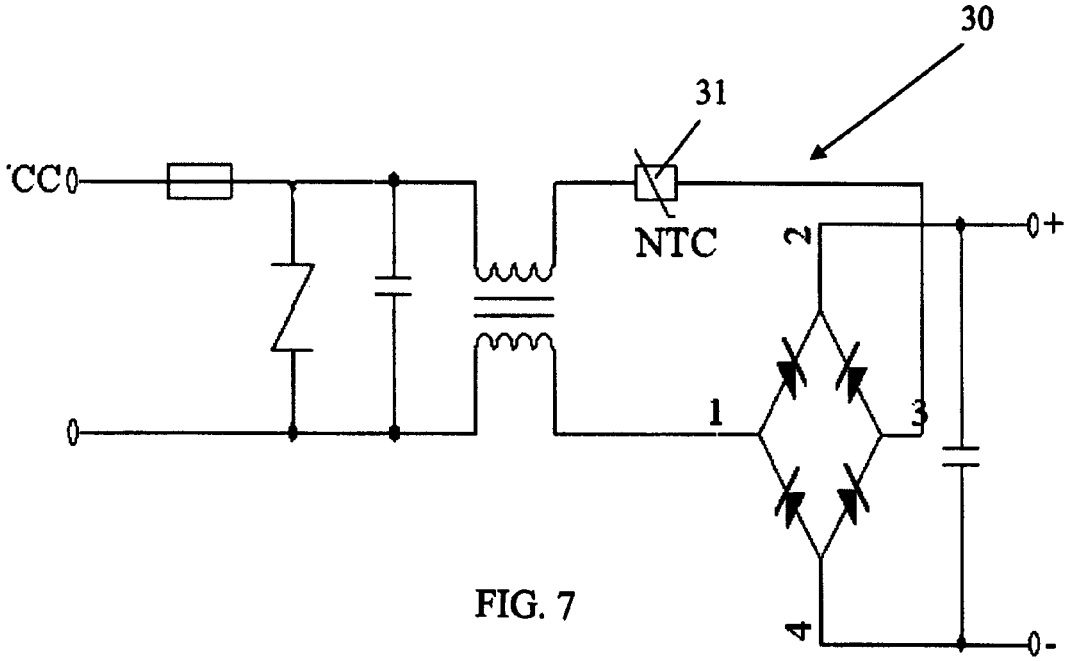
FIG. 7 is a circuit diagram of an over-current protection circuit of the present invention.

Referring to FIG. 7, the present invention also provides an over-current protection circuit 30. The over-current protection circuit 30 has a current limiting resistor or negative temperature coefficient (NTC) resistor 31 connected therein in series. The resistance of the NTC resistor 31 is quite big in the room temperature, thereby suppresses effectively the surge current.

The present invention also provides a pre-heating start-up circuit 32 connected to the LC output circuit 24 for providing a cathode of the lamp a pre-heating current and a predetermined pre-heating time to heat the cathode (glowers) to a desired temperature needed to turn on the cathode. However, before the cathode generates enough electron-fog and reaches excited state, the voltage put on the lamp should be low enough to prevent glow discharge, thereby protecting the cathode from damage.

Figure 8:
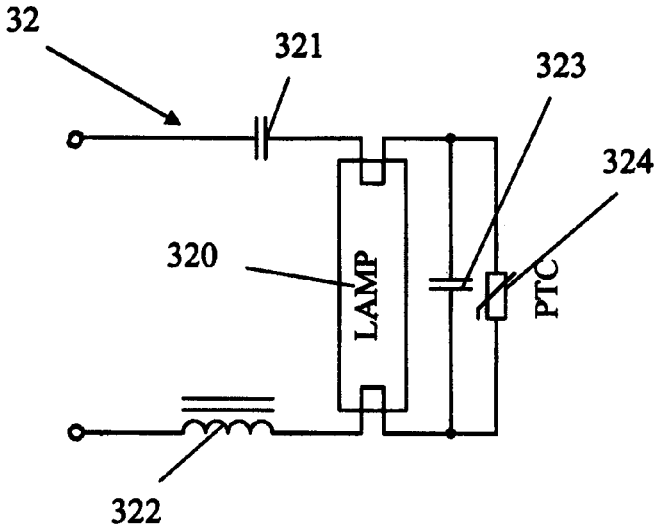
FIG. 8 is a circuit diagram of a first embodiment of a pre-heating start-up circuit of the present invention.

FIG. 8 is a circuit diagram of a first embodiment of the pre-heating start-up circuit 32 of the present invention. An LC resonant circuit composed of a first capacitor 321 and an inductance 322 has a fluorescent lamp 320 connected therein in series. A second capacitor 323 and a thermosensitive element such as a positive temperature coefficient (PTC) resistor 324 connect respectively in parallel to the fluorescent lamp 320. When the pre-heating start-up circuit starting, the resistance of the PTC resistor 324 is low, thereby to limit the voltage of the fluorescent lamp 320, which prevents the cathode of the lamp from glow discharge. The temperature and the resistance of the PTC resistor 324 increase with time. After 0.4 s to 1.5 s, the voltage of the second capacitor 323 increases rapidly to breakdown and enkindle the cathode of the lamp 320.

Figure 9:
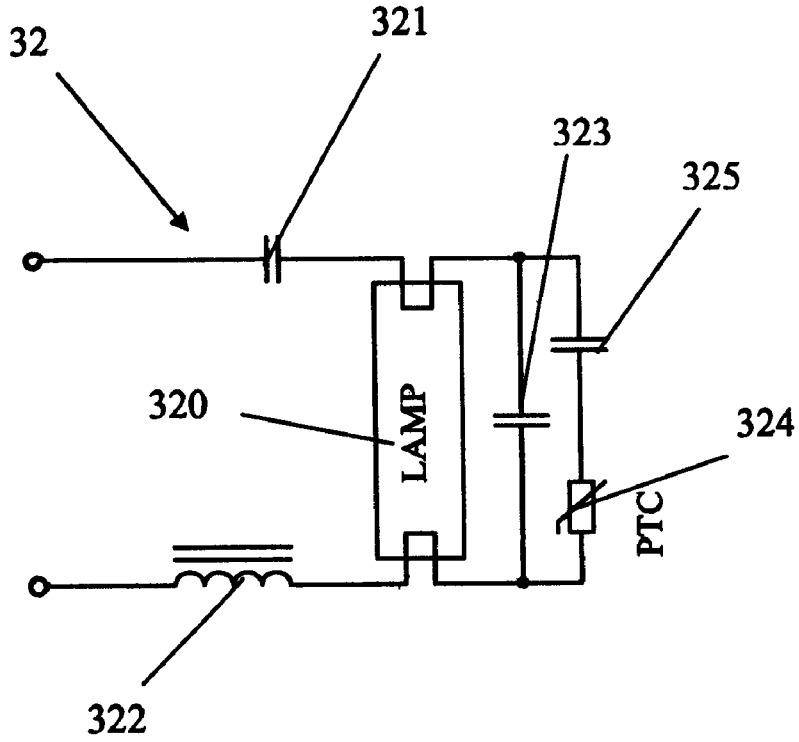
FIG. 9 is a circuit diagram of a second embodiment of a pre-heating start-up circuit of the present invention.

FIG. 9 is a circuit diagram of a second embodiment of the pre-heating start-up circuit 32 of the present invention which is similar with that shown in the first embodiment of FIG. 8 except that the PTC resistor 324 has a third capacitor 325 connected thereto in series, therefore a detailed description of which is omitted here from.

Figure 10:
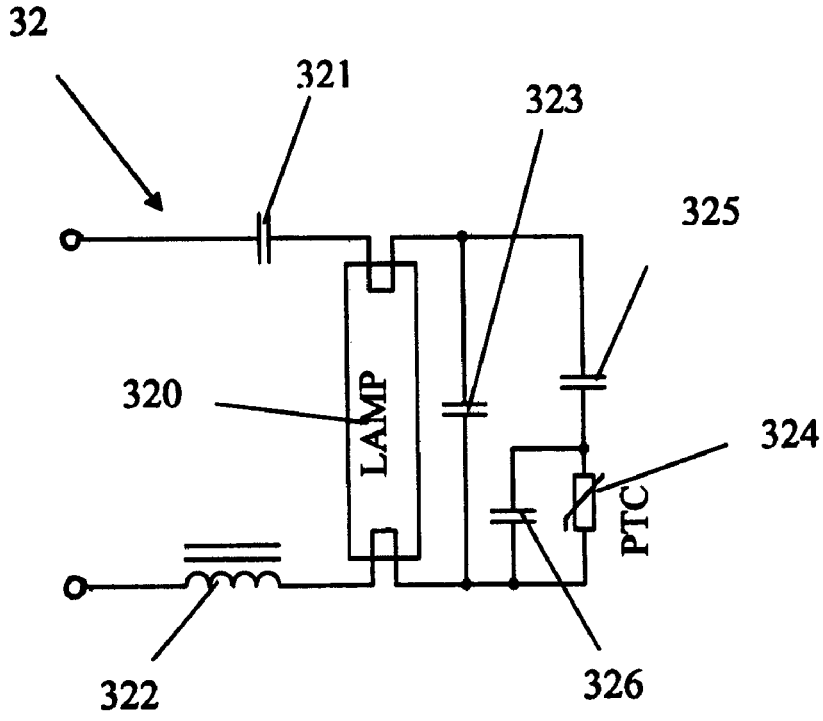
FIG. 10 is a circuit diagram of a third embodiment of a pre-heating start-up circuit of the present invention.

FIG. 10 is a circuit diagram of a third embodiment of a pre-heating start-up circuit 32 of the present invention which is similar with that shown in the second embodiment of FIG. 9 except that the PTC resistor 324 has a fourth capacitor 326 connected thereto in parallel, therefore a detailed description of which is also omitted here from.

Figure 11:
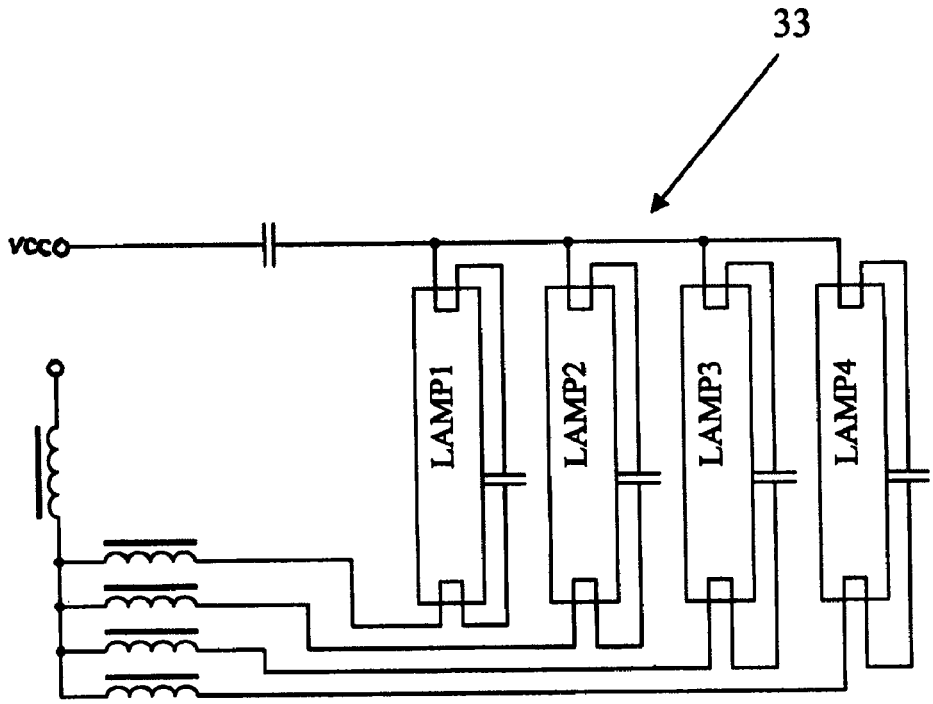
FIG. 11 is a circuit diagram of a first embodiment of a multi-loads working circuit of the present invention.

A multi-loads working circuit 33 is provided to connect to the LC output circuit 24. The multi-loads working circuit 33 is easy to install, reliable and power saving. As shown in FIG. 11, the multi-loads working circuit 33 is an LC lamps series resonant circuit for making four fluorescent lamps work simultaneity. Because the LC lamps series resonant circuit of the present invention is well known to persons ordinarily skilled in the art, a detailed description of such structure is omitted here from.

Figure 12:
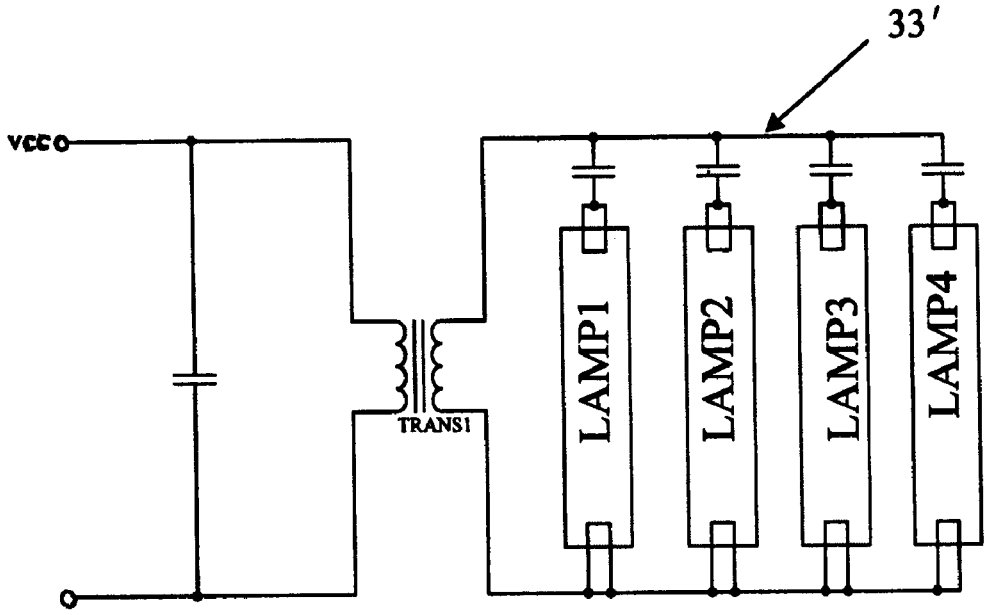
FIG. 12 is a circuit diagram of a second embodiment of a multi-loads working circuit of the present invention.

FIG. 12 shows a second embodiment of a multi-loads working circuit 33' of the present invention. The multi-loads working circuit 33' is a current push-pull lamps output circuit for making four fluorescent lamps work simultaneity. Because the current push-pull lamps output circuit of the present invention is well known to persons ordinarily skilled in the art, a detailed description of such structure is omitted here from.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A power-saving and stabilizing ballast comprising:

a bridge rectifier circuit, an electrolytic capacitive filter circuit, a half bridge inverter circuit, and an LC output circuit, all of which are sequentially and electrically connected;

an electromagnetic compatibility filter circuit electrically connected between a voltage input port and the bridge rectifier circuit for restraining high frequency currents from damaging electric power;

a power factor correction circuit electrically connected between the bridge rectifier circuit and the electrolytic capacitive filter circuit for enhancing power factor, reducing harmonic and achieving constant power output; and an abnormal state protection circuit electrically connected to the half bridge inverter circuit for protecting the ballast against damage from abnormal states;

wherein the abnormal state protection circuit has transistors to detect the magnitude of the current, thus to control the half bridge inverter circuit.

2. The power-saving and stabilizing ballast according to claim 1, wherein the electromagnetic compatibility filter circuit further comprises an over-voltage protection circuit for preventing transient spikes or over voltages from damaging the ballast, the over-voltage protection circuit includes a zinc oxide voltage dependent element.

3. The power-saving and stabilizing ballast according to claim 1, wherein the abnormal state protection circuit further includes an over-current protection circuit for suppressing surge currents, and the over-current protection circuit has a current limiting resistor connected therein in series.

4. The power-saving and stabilizing ballast according to claim 1, wherein the abnormal state protection circuit further includes an over-current protection circuit for suppressing surge currents, and the over-current protection circuit has a negative temperature coefficient resistor connected therein in series.

5. The power-saving and stabilizing ballast according to claim 1, furthering comprising a pre-heating start-up circuit electrically connected to the LC output circuit for providing a pre-heating current and a pre-heating time to a cathode of a fluorescent lamp before a system voltage thereof reaching a predetermined value, thereby avoiding glow discharge to cause the cathode damaged, the pre-heating start-up circuit having a thermosensitive element to heat glowers of the fluorescent lamp to a lighting temperature.

6. The power-saving and stabilizing ballast according to claim 1, wherein the LC output circuit further includes a multi-loads working circuit for making at least two fluorescent lamps work simultaneity.

7. The power-saving and stabilizing ballast according to claim 6, wherein the multi-loads working circuit is a LC lamps series resonance circuit.

8. The power-saving and stabilizing ballast according to claim 1, wherein the power factor correction circuit is an active power factor correction circuit.

9. The power-saving and stabilizing ballast according to claim 1, wherein the multi-loads working circuit is a current push-pull lamps output circuit.

* * * * *